US007836682B2

(12) United States Patent
Rasheed et al.

(10) Patent No.: US 7,836,682 B2
(45) Date of Patent: Nov. 23, 2010

(54) METHODS AND APPARATUS FOR OPERATING A PULSE DETONATION ENGINE

(75) Inventors: Adam Rasheed, Glenville, NY (US); Keith Robert McManus, Clifton Park, NY (US); Anthony John Dean, Scotia, NY (US)

(73) Assignee: General Electric Company, Schenectady, NY (US)

( * ) Notice: Subject to any disclaimer, the term of this patent is extended or adjusted under 35 U.S.C. 154(b) by 1320 days.

(21) Appl. No.: 11/352,773

(22) Filed: Feb. 13, 2006

(65) Prior Publication Data

US 2007/0186556 A1 Aug. 16, 2007

(51) Int. Cl.
*F02K 5/02* (2006.01)

(52) U.S. Cl. ..... 60/248; 60/39.76; 60/247; 60/39.38

(58) Field of Classification Search ..... 60/770, 60/771, 772, 247, 248, 262, 39.38, 39.5, 60/39.76, 725; 239/127.1, 127.3, 265.11–265.43; 181/213
See application file for complete search history.

(56) References Cited

U.S. PATENT DOCUMENTS 3,685,612 A * 8/1972 Bertin ..... 181/213
4,077,206 A * 3/1978 Ayyagari ..... 60/262
4,592,201 A * 6/1986 Dusa et al. ..... 60/262
4,830,315 A * 5/1989 Presz et al. ..... 244/200
4,835,961 A * 6/1989 Presz et al. ..... 60/264
5,473,885 A 12/1995 Hunter, Jr. et al.
5,937,635 A 8/1999 Winfree et al.
6,055,804 A * 5/2000 Hammond et al. ..... 60/39.5
6,347,509 B1 2/2002 Kaemming et al.
6,446,428 B1 9/2002 Kaemming et al.
6,449,939 B1 9/2002 Snyder
6,494,034 B2 12/2002 Kaemming et al.
6,606,854 B1 * 8/2003 Siefker et al. ..... 60/262
6,637,187 B2 10/2003 Sanders et al.
6,662,550 B2 12/2003 Eidelman et al.
6,668,542 B2 12/2003 Baker et al.
6,804,948 B2 * 10/2004 Oishi ..... 60/262
7,114,323 B2 * 10/2006 Schlinker et al. ..... 60/204
7,367,194 B2 * 5/2008 Murayama et al. ..... 60/776
7,434,384 B2 * 10/2008 Lord et al. ..... 60/262
2002/0059793 A1 5/2002 Kaemming et al.
2002/0078679 A1 6/2002 Kaemming et al.
2002/0166318 A1 11/2002 Baker et al.
2003/0200753 A1 10/2003 Eidelman et al.
2004/0099764 A1 5/2004 Leyva et al.
2007/0180811 A1 * 8/2007 Rasheed et al. ..... 60/39.76

* cited by examiner

*Primary Examiner*—Michael Cuff
*Assistant Examiner*—Young Choi
(74) *Attorney, Agent, or Firm*—Armstrong Teasdale LLP

(57) ABSTRACT

A method for operating a pulse detonation engine, wherein the method includes channeling air flow from a pulse detonation combustor into a flow mixer having an inlet portion, an outlet portion, and a body portion extending therebetween. The method also includes channeling ambient air past the flow mixer and mixing the air flow discharged from the pulse detonation combustor with the ambient air flow such that a combined flow is generated from the flow mixer that has less flow variations than the air flow discharged from the pulse detonation combustor.

16 Claims, 4 Drawing Sheets

METHODS AND APPARATUS FOR OPERATING A PULSE DETONATION ENGINE

BACKGROUND OF THE INVENTION

This invention relates generally to turbine engines, more particularly to methods and apparatus for operating a pulse detonation engine.

Known pulse detonation engines generally operate with a detonation process having a pressure rise, as compared to engines operating within a constant pressure deflagration. As such, pulse detonation engines may have the potential to operate at higher thermodynamic efficiencies than may generally be achieved with deflagration-based engines.

At least some known hybrid pulse detonation-turbine engines have replaced the steady flow constant pressure combustor within the engine with a pulse detonation combustor that may include at least one pulse detonation chamber. Although such engines vary in their implementation, a common feature amongst hybrid pulse detonation-turbine engines is that air flow from a compressor is directed into the pulse detonation chamber wherein the air is mixed with fuel and ignited to produce a combustion pressure wave. The combustion wave transitions into a detonation wave followed by combustion gases that are used to drive the turbine.

However, known pulse detonation engines generally do not include pulse detonation chamber designs that are optimized to direct steady and spatially uniform flows to the turbine. Rather, with at least some known pulse engines, an output flow from the pulse detonation chamber generally varies over time in both temperature and pressure. Reducing the number of flow variations from the pulse detonation chamber generally improves the performance of pulse detonation engines. More specifically, reduced flow variations may be critical to reducing flow losses, increasing engine efficiency, and increasing power.

BRIEF DESCRIPTION OF THE INVENTION

In one aspect, a method for operating a pulse detonation engine is provided. The method includes channeling air flow from a pulse detonation combustor into a flow mixer having an inlet portion, an outlet portion, and a body portion extending therebetween. The method also includes channeling ambient air past the flow mixer and mixing the air flow discharged from the pulse detonation combustor with the ambient air flow such that a combined flow is generated from the flow mixer that has less flow variations than the air flow discharged from the pulse detonation combustor.

In another aspect, a flow mixer for use with a pulse detonation combustor coupled to an axial turbine is provided. The flow mixer includes an inlet portion, an outlet portion, and a body portion extending therebetween. The inlet portion is configured to receive air flow discharged from the pulse detonation combustor and the body portion is configured to channel a bypass air flow circumferentially around the body portion. The outlet portion facilitates mixing pulse detonation combustor air flow with bypass air flow to produce a steady, uniform air flow towards the turbine.

In a further aspect, a pulse detonation engine is provided. The engine includes a pulse detonation combustor including at least one pulse detonation chamber that is configured to channel pulse detonation combustor air flow and bypass air flow towards an axial turbine. The engine also includes a flow mixer that is configured to receive and to mix the pulse detonation combustor air flow and the bypass air flow from the chamber to facilitate producing a steady, uniform air flow towards the turbine.

DETAILED DESCRIPTION OF THE INVENTION

Figure 1:
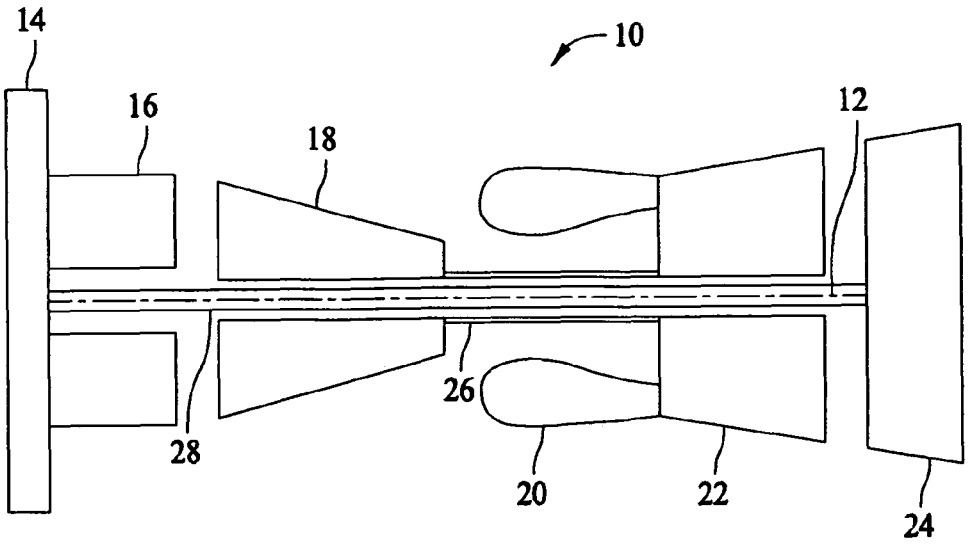
FIG. 1 is a schematic illustration of an exemplary hybrid pulse detonation-turbine engine.

FIG. 1 is a schematic illustration of an exemplary hybrid pulse detonation-turbine engine 10. Engine 10 includes, in serial axial flow communication about a longitudinal centerline axis 12, a fan 14, a booster 16, a high pressure compressor 18, and a pulse detonation combustor (PDC) 20, a high pressure turbine 22, and a low pressure turbine 24. High pressure turbine 22 is coupled to high pressure compressor 18 with a first rotor shaft 26, and low pressure turbine 24 is coupled to both booster 16 and fan 14 with a second rotor shaft 28, which is disposed within first shaft 26.

In operation, air flows through fan 14, booster 16, and high pressure compressor 18, being pressurized by each component in succession. At least a portion of the highly compressed air is delivered to PDC 20 and secondary or bypass portion flows over each component to facilitate cooling each component. Hot exhaust flow from PDC 20 drives turbines 22 and/or 24 before exiting gas turbine engine 10.

As used herein, the term "pulse detonation combustor" ("PDC") is understood to mean any combustion device or system wherein a series of repeating detonations or quasi-detonations within the device generate a pressure rise and subsequent acceleration of combustion products as compared to pre-burned reactants. The term "quasi-detonation" is understood to mean any combustion process that produces a pressure rise and velocity increase that are higher than the pressure rise and velocity produced by a deflagration wave. Typical embodiments of PDC include a means of igniting a fuel/oxidizer mixture, for example a fuel/air mixture, and a confining chamber, in which pressure wave fronts initiated by the ignition process coalesce to produce a detonation wave. Each detonation or quasi-detonation is initiated either by an external ignition, such as a spark discharge or a laser pulse, and/or by gas dynamic processes, such as shock focusing, auto-ignition or through detonation via cross-firing. The geometry of the detonation chamber is such that the pressure rise of the detonation wave expels combustion products from the PDC exhaust to produce a thrust force. As known to those skilled in the art, pulse detonation may be accomplished in a number of types of detonation chambers, including detonation tubes, shock tubes, resonating detonation cavities and annular detonation chambers.

Figure 2:
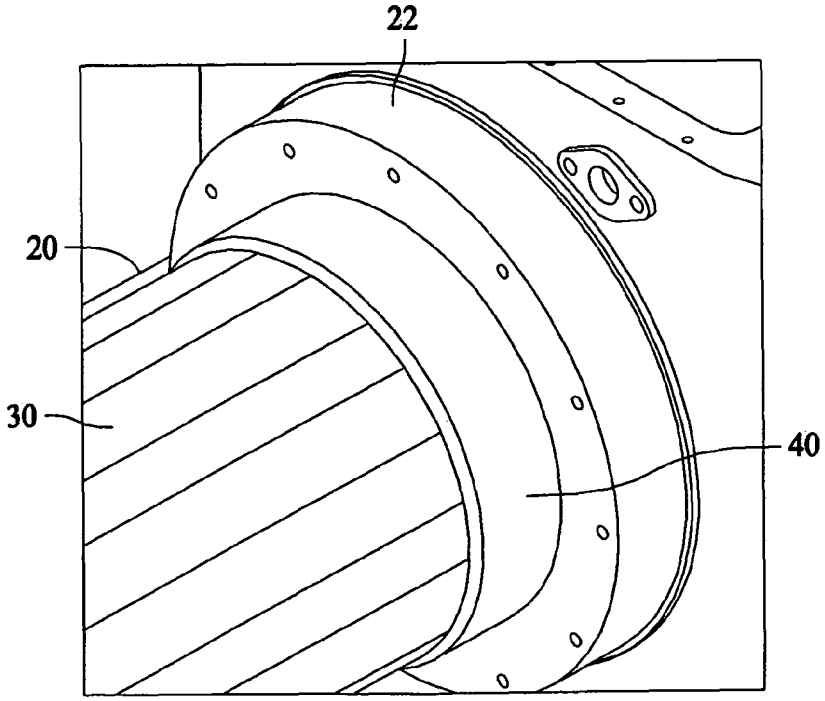
FIG. 2 is a perspective view of a portion of the hybrid pulse detonation-turbine engine shown in FIG. 1.

FIG. 2 is a perspective view of a portion of engine 10 shown in FIG. 1. In the exemplary embodiment, pulse detonation combustor (PDC) 20 includes a plurality of pulse detonation chambers 30 that are each coupled in flow communication to a flow mixer 40 such that combustion or "detonation" products expelled from chambers 30 flow downstream through flow mixer 40 towards turbine 22. In the exemplary embodiment, flow mixer 40 may be coupled to a respective chamber 30 via any conventional means including but not limited to welding, fasteners, or through a friction fit. Alternatively, each flow mixer 40 may be coupled to a respective chamber 30 via any means that enables flow mixer 40 to function as described herein. In the exemplary embodiment, flow mixer 40 may be fabricated from, but is not limited to any of the following materials, inconel, hastelloy, stainless steel, aluminum, or any other material suitable for use in combustors. In alternative embodiments, flow mixer 40 may be fabricated from any material that allows flow mixer to function as described herein.

Figure 3:
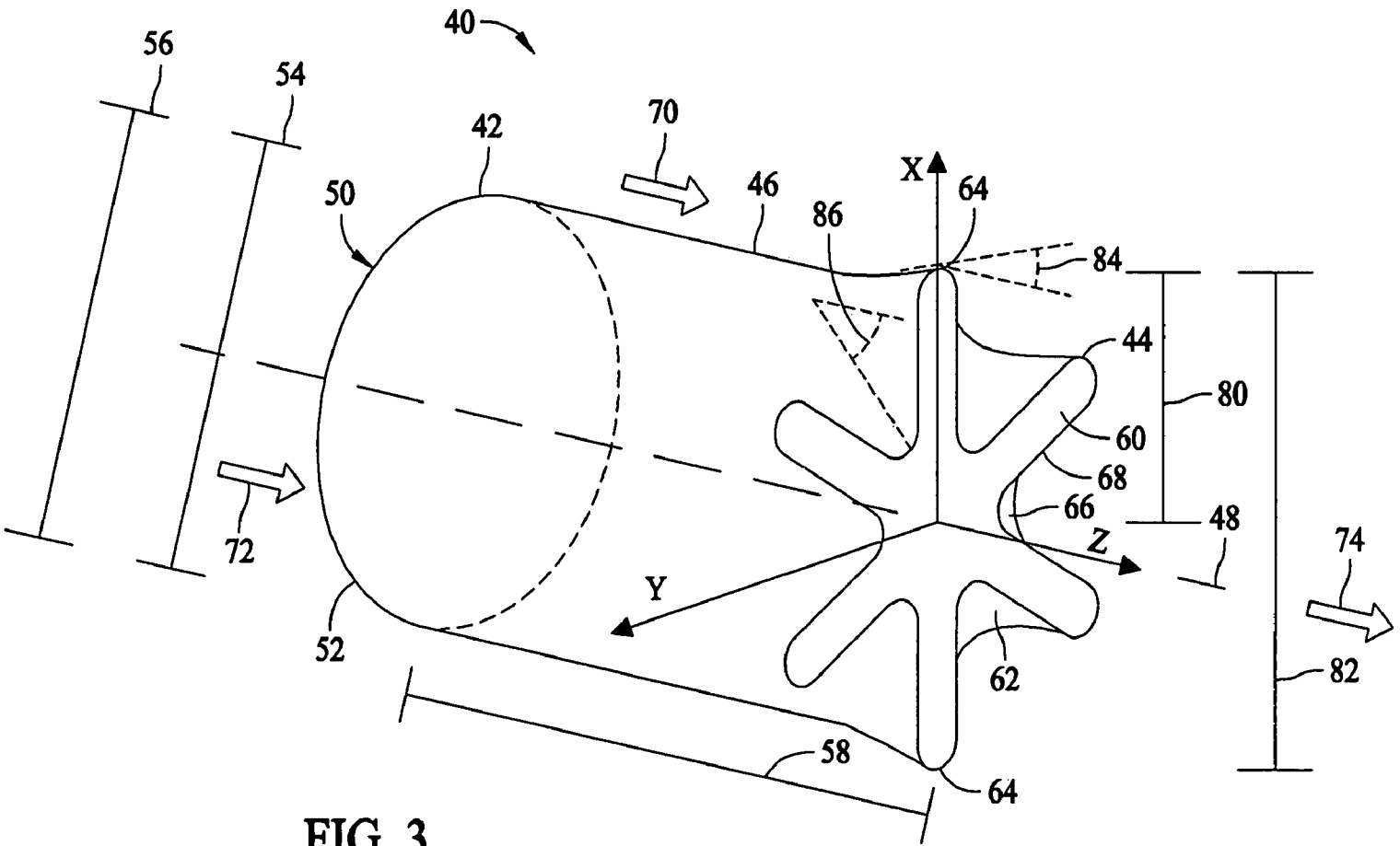
FIG. 3 is a perspective view of an exemplary embodiment of a flow mixer that may be used with the hybrid pulse detonation-turbine engine shown in FIG. 1.

FIG. 3 is a perspective view of an exemplary embodiment of flow mixer 40. Flow mixer 40 includes an inlet portion 42, an outlet portion 44, and a body portion 46 extending therebetween about a centerline axis 48. In the exemplary embodiment, each inlet portion 42 is coupled to each respective chamber 30 and each flow mixer 40 includes a substantially circular aperture 50 defined by an outer perimeter 52. Accordingly, in the exemplary embodiment, aperture 50 has a substantially constant diameter 54. In alternative embodiments, inlet portion 42 is shaped and sized to enable flow mixer 40 to be coupled in flow communication with chamber 30.

In the exemplary embodiment, body portion 46 has substantially the same shape as inlet portion 42 and has a diameter 56 that is substantially constant from inlet portion 42 to outlet portion 44 along a length 58 of body portion 46. Specifically, in the exemplary embodiment, body diameter 56 is approximately equal to body diameter 54. In alternative embodiments, body portion diameter 56 is variable along body length 58.

In the exemplary embodiment, outlet portion 44 transitions from the substantially circular shape of body portion 46 to a lobed or "daisy" shape gradually that facilitates channeling hot exhaust flow from chamber 30 towards turbine 22 (shown in FIG. 1). In the exemplary embodiment, outlet portion 44 includes continuous inner and outer surfaces 60 and 62 that form a plurality of alternating lobe peaks 64 and lobe troughs 66 that are spaced circumferentially apart about axis 48 to define flow mixer 40. In the exemplary embodiment, lobe peaks 64 and lobe troughs 66 extend generally axially from body portion 46. Specifically, in the exemplary embodiment, each lobe 64 projects substantially radially outwardly from centerline axis 48 and each trough 66 extends substantially radially inwardly between adjacent lobes 64, and as such, lobes 64 and troughs 66 share common radial sidewalls 68 therebetween.

Peaks 64 and troughs 66 facilitate mixing cool ambient or bypass air flow 70 with hot exhaust gas flow 72 to form a steady and spatially uniform combined air flow 74. Specifically, peaks 64 enable higher temperature or hot flow 72 to be channeled in a generally axial direction along centerline axis 48 while, simultaneously, troughs 66 direct lower temperature or cool flow 70 toward centerline axis 48 and towards hot flow 72, thus resulting in mixing the flows 70 and 72 to form a combined flow 74.

In the exemplary embodiment, each peak 64 has a height 80 measured between centerline axis 48 and outlet portion 44. Moreover, in the exemplary embodiment, outlet portion 44 has a diameter 82 defined by diametrically opposite peaks 64, for example. In the exemplary embodiment, outlet diameter 82 is larger than body diameter 54. In alternative embodiments, outlet diameter 82 is smaller than, or approximately the same size as, body diameter 54. In the exemplary embodiment, outlet portion 44 is oriented such that each peak 64 is angled outward from body 46 at an angle 84 and each trough 66 is angled inward from body 46 at an angle 86. Angles 84 and 86 are variable depending on the various engine parameters, engine demands, or specific engine requirements.

In operation, air flow 70 is directed along body 46 and around peaks 64 and through troughs 66 where at least a portion of air flow 70 is directed towards axis 48, simultaneously, air flow 72 is directed through body 46 and through peaks 64 and around troughs 66 where at least a portion of air flow 72 is directed towards axis 48. Peaks 64 and troughs 66 substantially "slice" each respective air flow 70 and 72 which facilitates mixing flows 70 and 72 into combined flow 74 that is cooler than hot flow 72. In one embodiment, peaks 64 and troughs 66 are angled to facilitate generating counter-rotating vortices which enhances mixing of flows 70 and 72 into combined flow 74 that is cooler than hot flow 72.

Figure 4:
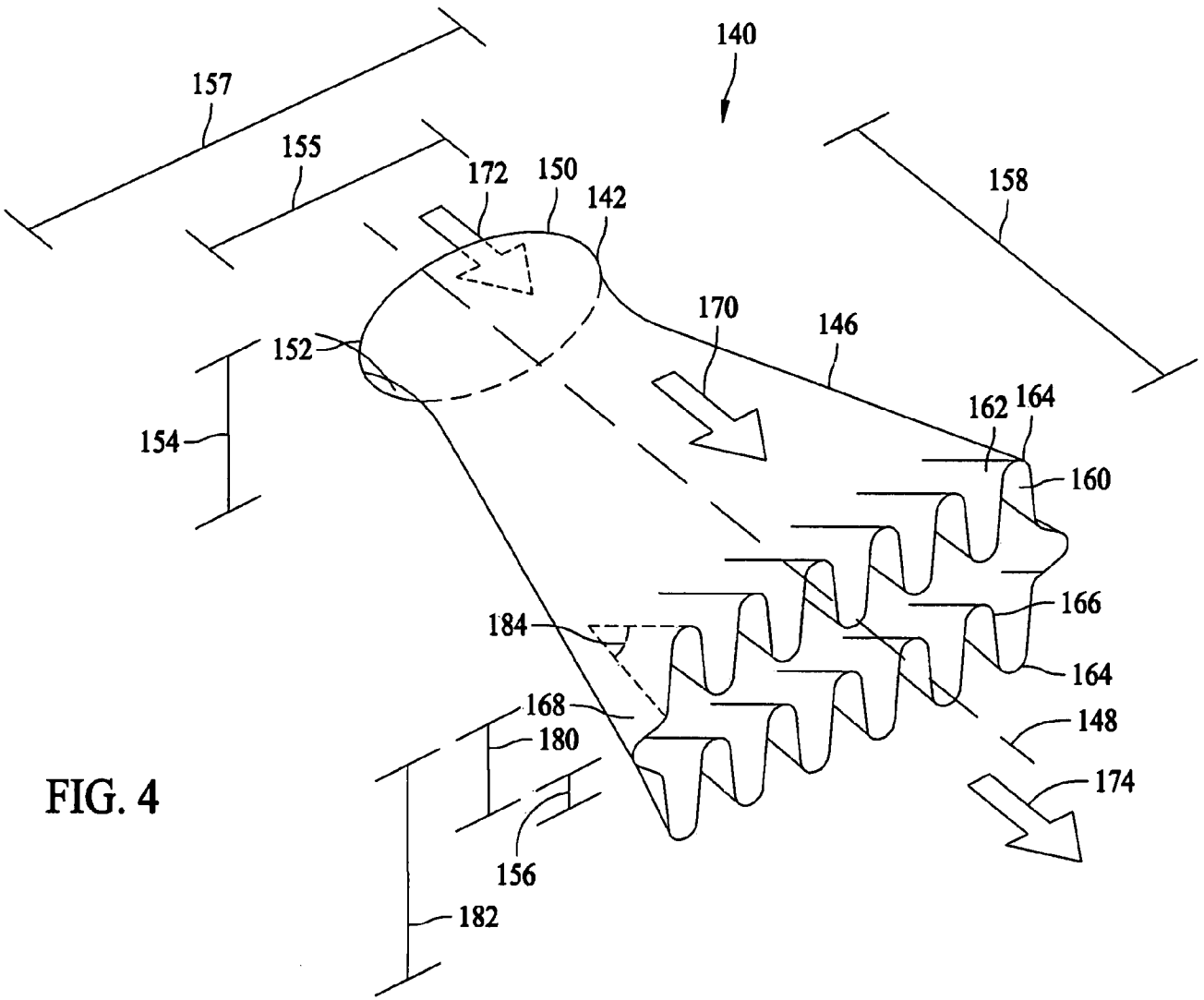
FIG. 4 is a perspective view of an alternative embodiment of a flow mixer that may be used with hybrid pulse detonation-turbine engine shown in FIG. 1.

FIG. 4 is a perspective view of an alternative embodiment of flow mixer 140. Flow mixer 140 includes an inlet portion 142, an outlet portion 144, and a body portion 146 extending therebetween about a centerline axis 148. In the exemplary embodiment, each inlet portion 142 is coupled to each respective chamber 30 and each includes a substantially elliptical aperture 150 defined by an outer perimeter 152. Accordingly, in the exemplary embodiment, aperture 150 has a minor axis 154 and a major axis 155. In alternative embodiments, inlet portion 142 is shaped and sized to enable flow mixer 140 to be coupled in flow communication with chamber 30.

In the exemplary embodiment, body portion 146 has substantially the same shape as inlet portion 142 such that inlet portion 142 transitions gradually to outlet portion 144 along a length 158 of body portion 146. Specifically, in the exemplary embodiment, body portion 146 has a minor axis (not shown) that is shorter than inlet minor axis 154 and a major axis (not shown) that is longer than inlet major axis 155. In alternative embodiments, body portion 146 minor axis is longer than inlet minor axis 154 and body portion 146 major axis is smaller than inlet major axis 155.

In the exemplary embodiment, outlet portion 144 transitions gradually from the substantially elliptical shape of body portion 146 to a lobed shape that facilitates channeling the hot exhaust flow from chamber 30 towards turbine 22 (shown in FIG. 1). In the exemplary embodiment, outlet portion 144 has a height 156 and a diameter 157 that each transition from body portion 146 to outlet portion 144. Specifically, in the exemplary embodiment, outlet height 156 is shorter than inlet minor axis 154 and outlet diameter 157 is longer than inlet major axis 155. In alternative embodiments, outlet height 156 is approximately equal to inlet minor axis 154 and outlet diameter 157 is approximately equal to inlet major axis 155. In the exemplary embodiment, outlet portion 144 includes continuous inner and outer surfaces 160 and 162 that form a plurality of vertically-oriented, alternating lobe peaks 164 and lobe troughs 166 that are spaced circumferentially about flow mixer 140. In the exemplary embodiment, lobe peaks 164 and lobe troughs 166 are spaced from one another in two horizontal rows perpendicular to the plane wherein the two rows are vertically separate from one another and extend generally outwardly from body portion 146. Specifically, in the exemplary embodiment, each lobe 164 projects substantially vertically outwardly from centerline axis 148 and each trough 166 extends along the same plane as body portion 146 between adjacent lobes 164, and as such lobes 164 and troughs 166 share common sidewalls 168 therebetween. In an alternative embodiment, each lobe 164 projects substantially vertically outwardly from centerline axis 148 and each trough 166 extends substantially inwardly towards centerline axis 148 between adjacent lobes 164, and as such lobes 164 and troughs 166 share common radial sidewalls 168 therebetween.

Peaks 164 and troughs 166 facilitate mixing cool ambient or bypass air flow 170 with hot exhaust gas flow 172 to form a steady and spatially uniform combined air flow 174. Specifically, peaks 164 enable higher temperature or hot flow 172 to be channeled along centerline axis 148 while, simultaneously, troughs 166 direct lower temperature or cool flow 170 toward centerline axis 148 towards hot flow 172, thus resulting in mixing the flows 170 and 172 to form a combined flow 174.

In the exemplary embodiment, each peak 164 has a height 180 measured between centerline axis 148 and outlet portion 144. Moreover, in the exemplary embodiment, outlet portion 144 has a height 182 defined by opposite peaks 164. In the exemplary embodiment, outlet diameter 182 is longer than body portion 146 minor axis. In the exemplary embodiment, outlet portion 144 is oriented such that each peak 164 is angled outward from body diameter along an angle 184. In alternative embodiments, trough 166 may have an inward angle (not shown). Angle 184 is variable depending on the various engine parameters, engine demands, or specific engine requirements.

In operation, air flow 170 is directed along body 146 and around peaks 164 and through troughs 166 where at least a portion of air flow 170 is directed towards axis 148, simultaneously, air flow 172 is directed through body 146 and through peaks 164 and around troughs 166 where at least a portion of air flow 172 is directed towards axis 148. Peaks 164 and troughs 166 substantially vertically "slice" each respective air flow 172 and 170 which facilitates mixing flows 172 and 170 into combined flow 174 that is cooler than hot flow 172.

Figure 5:
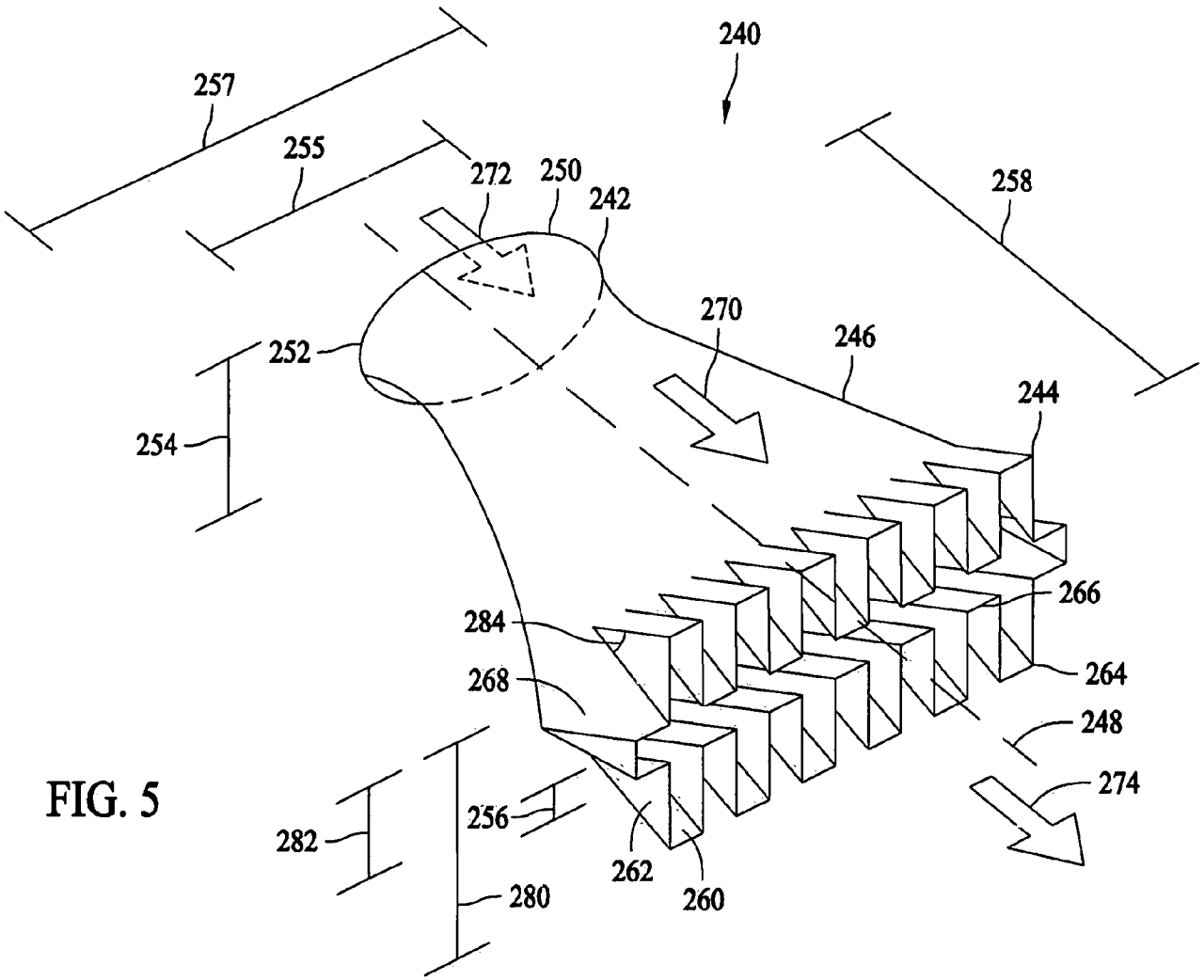
FIG. 5 is a perspective view of a further alternative embodiment of a flow mixer that may be used with hybrid pulse detonation-turbine engine shown in FIG. 1.

FIG. 5 is a perspective view of a further alternative embodiment of flow mixer 240. Flow mixer 240 includes an inlet portion 242, an outlet portion 244, and a body portion 246 extending therebetween about a centerline axis 248. In the exemplary embodiment, each inlet portion 242 is coupled to each respective chamber 30 and each includes a substantially elliptical aperture 250 defined by an outer perimeter 252. Accordingly, in the exemplary embodiment, aperture 250 has a substantially constant height 254 and a diameter 255. In alternative embodiments, inlet portion 242 is shaped and sized to enable flow mixer 240 to be coupled in flow communication to chamber 30.

In the exemplary embodiment, body portion 246 has substantially the same shape as inlet portion 242 such that inlet portion 242 transitions gradually to outlet portion 244 along a length 258 of body portion 246. Specifically, in the exemplary embodiment, body portion 246 has a minor axis (not shown) that is shorter than inlet minor axis 254 and a major axis (not shown) that is longer than inlet major axis 255. In alternative embodiments, body portion 246 minor axis is longer than inlet minor axis 254 and body portion 246 major axis is smaller than inlet major axis 255.

In the exemplary embodiment, outlet portion 244 transitions gradually from the substantially elliptical shape of body portion 246 to a square-wave lobed shape that facilitates channeling the hot exhaust flow from chamber 30 towards turbine 22 (shown in FIG. 1). In the exemplary embodiment, outlet portion 244 has a height 256 and a diameter 257 that each transition from body portion 246 to outlet portion 244. Specifically, in the exemplary embodiment, outlet height 256 is shorter than inlet minor axis 254 and outlet diameter 257 is longer than inlet major axis 255. In alternative embodiments, outlet height 256 is approximately equal to inlet minor axis 254 and outlet diameter 257 is approximately equal to inlet major axis 255. In the exemplary embodiment, outlet portion 244 includes continuous inner and outer surfaces 260 and 262 that form a plurality of vertically-oriented, alternating lobe peaks 264 and lobe troughs 266 that are spaced circumferentially about flow mixer 240. In the exemplary embodiment, lobe peaks 264 and lobe troughs 266 are spaced from one another in two horizontal rows perpendicular to the plane wherein the two rows are vertically separate from one another and extend vertically from body portion 246. Specifically, in the exemplary embodiment, each lobe 264 projects substantially vertically outwardly from centerline axis 248 and each trough 266 extends along the same plane as body portion 246 between adjacent lobes 264, and as such lobes 264 and troughs 266 share common sidewalls 268 therebetween. In an alternative embodiment, each lobe 264 projects substantially vertically outwardly from centerline axis 248 and each trough 266 extends substantially inwardly towards centerline axis 148 between adjacent lobes 264, and as such lobes 264 and troughs 266 share common radial sidewalls 268 therebetween.

Peaks 264 and troughs 266 facilitate mixing cool ambient or bypass air flow 270 with hot exhaust gas flow 272 to form a steady and spatially uniform combined air flow 274. Specifically, peaks 264 enable higher temperature or hot flow 272 to be channeled along centerline axis 248 while, simultaneously, troughs 266 direct lower temperature or cool flow 270 toward centerline axis 248 and towards hot flow 272, thus resulting in mixing flows 270 and 272 to form a combined flow 274.

In the exemplary embodiment, each peak 264 has a height 280 measured between centerline axis 248 and outlet portion 244. Moreover, in the exemplary embodiment, outlet portion 244 has a height 282 defined by opposite peaks 264. In the exemplary embodiment, outlet diameter 282 is larger than body portion 246 minor axis. In the exemplary embodiment, outlet portion 244 is oriented such that each peak 264 is angled outward from body diameter along an angle 284. In alternative embodiments, trough 266 may have an inward angle (not shown). Angle 284 is variable depending on the various engine parameters, engine demands, or specific engine requirements.

In operation, peaks 264 and troughs 266 produce substantially vertical "slices" each respective of air flow 272 and 270. The vertical slices alternate and facilitate mixing flows 272 and 270 into combined flow 274 that is cooler than hot flow 272.

The above-described turbine engine is efficient, cost effective, and highly reliable. The engine includes at least one flow mixer configured to facilitate reduce flow variations generated from the pulse detonation combustor. Each flow mixer an inlet portion, an outlet portion, and a body extending therebetween configured to optimize power extraction from the pulse detonation combustor by mixing cool bypass air flow and hot pulse detonation combustor air flow. Mixing air flows facilitates reducing non-uniform flow fields generate towards downstream turbines. As a result, the described flow mixer facilitates improving overall efficiency in a cost effective and reliable manner taking advantage of the efficiency gain of pulse detonation engines.

Exemplary embodiments of flow mixers are described above in detail. The flow mixers are not limited to the specific embodiments described herein, but rather, components of the flow mixers may be utilized independently and separately from other components described herein. Each flow mixer component can also be used in combination with other turbine components.

While the invention has been described in terms of various specific embodiments, those skilled in the art will recognize that the invention can be practiced with modification within the spirit and scope of the claims.

What is claimed is:

1. A method for operating a pulse detonation engine, said method comprising:

channeling air flow from a pulse detonation combustor into a flow mixer having an inlet portion, an outlet portion, and a body portion extending therebetween, such that the pulse detonation combustor air flow is channeled through a plurality of outwardly extending flow mixer lobe peaks;

channeling ambient air past the flow mixer, such that the ambient air flow is channeled over a plurality of flow mixer lobe troughs;

mixing the air flow discharged from the pulse detonation combustor with the ambient air flow such that a combined flow is generated from the flow mixer that has less flow variations than the air flow discharged from the pulse detonation combustor; and channeling the combined flow downstream towards an axial turbine.

2. A method in accordance with claim 1 wherein channeling air flow from a pulse detonation combustor into a flow mixer further comprises:

coupling the flow mixer inlet portion in flow communication with a pulse detonation combustor chamber; and channeling pulse detonation combustor air flow through the flow mixer inlet portion.

3. A method in accordance with claim 1 wherein channeling a ambient air past the flow mixer further comprises circumferentially channeling ambient air flow about the flow mixer body portion towards the flow mixer outlet portion.

4. A method in accordance with claim 1 wherein mixing the air flow discharged from the pulse detonation combustor with the ambient air flow further comprises channeling the pulse detonation combustor air flow through a plurality of outwardly projecting flow mixer lobe peaks and channeling the ambient air flow over a plurality of inwardly extending flow mixer lobe troughs to facilitate mixing the flows together.

5. A method in accordance with claim 4 wherein channeling the pulse detonation combustor air flow through a plurality of outwardly projecting flow mixer lobe peaks and channeling the ambient air flow over a plurality of inwardly extending flow mixer lobe troughs further comprises radially-extending and alternating the flow mixer lobe peaks and troughs such that flow mixer lobe peaks and troughs spaced circumferentially about flow mixer, and extend axially from flow mixer body portion, wherein each flow mixer lobe projects radially outwardly from the flow mixer centerline axis and each flow mixer trough extends radially inwardly between adjacent flow mixer lobes, and as such flow mixer lobe peaks and troughs share common radial sidewalls therebetween.

6. A method in accordance with claim 4 wherein channeling the pulse detonation combustor air flow through a plurality of outwardly projecting flow mixer lobe peaks and channeling the ambient air flow over a plurality of inwardly extending flow mixer lobe troughs further comprises vertically-extending, alternating flow mixer lobe peaks and troughs such that the flow mixer lobe peaks and troughs are spaced circumferentially about flow mixer, and are spaced from one another in two horizontal rows perpendicular to the plane wherein the two rows are vertically separate from one another and extend vertically from the flow mixer body portion, and as such flow mixer lobe peaks and troughs share common radial sidewalls therebetween.

7. A flow mixer for use with a pulse detonation combustor coupled to an axial turbine, said flow mixer coupled between the pulse detonation combustor and the axial turbine, said flow mixer comprises an inlet portion, an outlet portion, and a body portion extending therebetween, said inlet portion configured to receive air flow discharged from the pulse detonation combustor, said body portion configured to channel a bypass air flow circumferentially around said body portion, said outlet portion configured to mix pulse detonation combustor air flow with bypass air flow by channeling pulse detonation combustor air flow through a plurality of lobes that project outward from a centerline axis and by channeling the bypass air flow past a plurality of troughs to produce a steady, substantially uniform combined air flow that is channeled generally axially along the centerline axis towards the turbine.

8. A flow mixer in accordance with claim 7 wherein said plurality of outwardly projecting lobes and said plurality of troughs are spaced circumferentially about said flow mixer, wherein each said lobe projects radially outwardly from a flow mixer centerline axis and each said trough extends parallel to the flow mixer centerline between adjacent said lobes, such that said plurality of lobes and troughs share common radial sidewalls therebetween.

9. A flow mixer in accordance with claim 7 wherein said plurality of outwardly projecting lobes and said plurality of troughs are spaced circumferentially about said flow mixer, wherein each said lobe projects radially outwardly from a flow mixer centerline axis and each said trough extends radially inwardly towards the flow mixer centerline axis between adjacent said lobes, and wherein said plurality of lobes and troughs are spaced from one another in two horizontal rows perpendicular to the flow mixer centerline axis wherein said two rows are vertically separate from one another, such that said plurality of lobes and troughs share common radial sidewalls therebetween.

10. A flow mixer in accordance with claim 7 wherein said flow mixer is further configured to channel the pulse detonation combustor air flow through said plurality of outwardly projecting lobes and channel the bypass air flow past said plurality of inwardly extending troughs such that a combined flow is produced from said flow mixer and is channeled towards the turbine.

11. A flow mixer in accordance with claim 10 wherein said plurality of outwardly projecting lobes and said plurality of inwardly extending troughs are spaced circumferentially about said flow mixer, wherein each said lobe projects radially outwardly from a flow mixer centerline axis and each said trough extends radially inwardly towards the flow mixer centerline axis between adjacent pairs of said lobes, such that said plurality of lobes and troughs share common radial sidewalls therebetween.

12. A flow mixer in accordance with claim 10 wherein said plurality of outwardly projecting lobes and said plurality of inwardly extending troughs are spaced circumferentially about said flow mixer, wherein each said lobe projects vertically outwardly from a flow mixer centerline axis and each said trough extends vertically inwardly towards the flow mixer centerline axis between adjacent said lobes, and wherein said plurality of lobes and troughs are spaced from one another in two horizontal rows perpendicular to the flow mixer centerline axis wherein said two rows are vertically separate from one another, such that said plurality of lobes and troughs share common radial sidewalls therebetween.

13. A pulse detonation engine comprising:

a pulse detonation combustor comprising at least one pulse detonation chamber configured to channel pulse detonation combustor air flow and bypass air flow towards an axial turbine, said pulse detonation combustor further comprising an outlet portion; and a flow mixer coupled between said pulse detonation combustor and the axial turbine, said flow mixer comprising a plurality of lobes extending outwardly from said outlet portion and a plurality of troughs extending inwardly from said outlet portion, said flow mixer configured to direct the pulse detonation combustion air flow through said plurality of lobes and direct the bypass air flow over said plurality of troughs such that a combined airflow is generated to facilitate producing a steady, uniform air flow towards said turbine.

14. A turbine in accordance with claim 13 wherein said flow mixer is configured to generate a combined flow having less flow variations than the pulse detonation combustor air flow.

15. A turbine in accordance with claim 13 wherein said plurality of outwardly projecting lobes and said plurality of inwardly extending troughs are spaced circumferentially about said flow mixer, wherein each said lobe projects radially outwardly from a flow mixer centerline axis and each said trough extends radially inwardly from the flow mixer centerline between adjacent said lobes, and as such said plurality of lobes and troughs share common radial sidewalls therebetween.

16. A turbine in accordance with claim 13 wherein said plurality of outwardly projecting lobes and said plurality of inwardly extending troughs are spaced circumferentially spaced about said flow mixer, wherein each said lobe projects vertically outwardly from a flow mixer centerline axis and each said trough extends vertically inwardly from the flow mixer centerline between adjacent said lobes, and wherein said plurality of lobes and troughs are spaced from one another in two horizontal rows perpendicular to the plane wherein said two rows are vertically separate from one another, and as such plurality of lobes and troughs share common radial sidewalls therebetween.

* * * * *